United States Patent [19]

Focke

[11] Patent Number: 4,984,409

[45] Date of Patent: Jan. 15, 1991

[54] PROCESS AND APPARATUS FOR THE TESTING OF CARTON PACKS

[75] Inventor: Heinz Focke, Verden, Fed. Rep. of Germany

[73] Assignee: Focke & Co. (GmbH & Co.), Verden, Fed. Rep. of Germany

[21] Appl. No.: 569,253

[22] Filed: Aug. 16, 1990

Related U.S. Application Data

[63] Continuation of Ser. No. 346,449, May 1, 1989, abandoned.

[30] Foreign Application Priority Data

May 18, 1988 [DE] Fed. Rep. of Germany ..... 3816856

[51] Int. Cl.[5] ..... B65B 57/02; B65B 57/04

[52] U.S. Cl. ..... 53/53; 53/137; 73/821; 493/12; 493/16; 493/37

[58] Field of Search ..... 53/53, 137; 73/821; 493/12, 16, 37

[56] References Cited

U.S. PATENT DOCUMENTS

| | | | |
|---|---|---|---|
| 2,518,959 | 8/1950 | Tinker | 73/821 |
| 3,041,873 | 2/1962 | Godshall | 73/821 |
| 3,052,072 | 9/1962 | Keely et al. | 493/37 |
| 3,464,260 | 9/1969 | Heyman | 73/821 |
| 3,518,805 | 7/1970 | Udall et al. | 53/53 |
| 3,714,759 | 2/1973 | Pagdin et al. | 53/53 |
| 3,939,063 | 2/1976 | Epperson et al. | 209/3.1 |
| 4,349,998 | 9/1982 | Covert | 493/16 |
| 4,643,027 | 2/1987 | Deutsch et al. | 53/53 |

FOREIGN PATENT DOCUMENTS

| | | | |
|---|---|---|---|
| 1934390 | 1/1970 | Fed. Rep. of Germany . | |
| 1561424 | 3/1971 | Fed. Rep. of Germany . | |
| 7318466 | 9/1973 | Fed. Rep. of Germany . | |
| 0896517 | 1/1982 | U.S.S.R. | 73/821 |
| 2010768 | 7/1979 | United Kingdom . | |

*Primary Examiner*—William E. Terrell

*Attorney, Agent, or Firm*—Sughrue, Mion, Zinn, Macpeak & Seas

[57] ABSTRACT

Conventionally, large-volume carton packs are constructed in such a way that two mutually opposite walls (bottom wall 19 and cover wall 20) are formed from folding tabs (15 to 18) overlapping one another. The folding tabs are connected to one another by adhesive bonding. Furthermore, an adhesive strip (51) can be affixed in the region of a parting line (25) between the outer tabs (17, 18) butting against one another. The connection between the folding tabs or the arrangement of the adhesive strip (51) may be defective. Thus, according to the invention, in order to check the carton pack (10) in terms of a correct construction, pressure is exerted on the walls (bottom wall 19 and cover wall 20) formed from folding tabs, in such a way that any inadequate connections result in a springing open of the respective walls. The change in shape of the carton pack (10) is detected by sensors, especially by photosensors (87, 88). Any faulty packs are separated out of the feed stream, put in order and reintroduced into the stream.

16 Claims, 7 Drawing Sheets

PROCESS AND APPARATUS FOR THE TESTING OF CARTON PACKS

This is a continuation of application Ser. No. 346,449, filed May 1, 1989, now abandoned.

BACKGROUND OF THE INVENTION

The invention relates to a process for the testing of carton packs in terms of the correct construction of (bottom and/or cover) walls formed from folding tabs or flaps and fixed by means of adhesive bonding and/or adhesive strips. The invention relates furthermore to an apparatus for carrying out the process.

The carton packs under consideration here are primarily large-volume packs made of corrugated cardboard or the like. They serve predominantly for receiving smaller packs. For example, small bundles of cigarette packs, namely so-called cigarette sticks containing, for example, ten or twenty cigarette packs, are packaged in carton packs of this type.

Conventionally, blanks for the production of carton packs are first folded so as to obtain a square or rectangular "tube" surrounding the pack content and open on two sides located opposite one another. These open sides are subsequently closed by means of folding tabs or flaps partially overlapping one another, in particular two mutually complementary inner tabs located opposite one another and two mutually complementary outer tabs likewise located opposite one another. The bottom wall and the cover wall are thus obtained by means of the folding tabs.

In order to close the carton pack in a durable manner, the folding tabs or flaps are connected to one another by adhesive bonding. For this purpose, glue spots are coated on to the inner tabs and/or on to the inner face of the outer tabs. Additionally or alternatively, the carton pack can be closed by means of an adhesive strip affixed on the outside.

SUMMARY OF THE INVENTION

The invention is concerned with the testing of the closure of such or similar carton packs.

The object on which the invention is based is to determine reliably any errors in the region of the closure, particularly in the region of the walls formed from the folding tabs or flaps.

To achieve this object, the process according to the invention is characterized in that, immediately after the walls have been completed by folding the folding tabs, pressure is exerted on the latter in the region of adjacent carton edges, in such a way that the folding tabs of incorrectly constructed walls are moved out of the wall plane.

The pressure treatment according to the invention performed on the folding tabs adhesively bonded or connected to one another ensures that even those defective carton packs in which the connection of the folding tabs is outwardly apparently correct are identified. The exertion of pressure in the plane of the walls formed by the folding tabs ensures that inadequate (adhesive) bonds result in a springing open of the folding tabs and therefore the detection of the faulty pack.

According to the invention, because the folding tabs or flaps on defective carton packs project sideways (in relation to the conveying direction of the carton packs), they can be detected automatically by sensors, especially by optical sensors (light barriers), and separated out.

The faulty packs are diverted out of the conveying stream of carton packs into the region of a correcting station. Here, the defects on the carton pack are rectified manually. The corrected pack is then reintroduced into the pack stream.

The apparatus according to the invention for the testing of carton packs is equipped, after a glue-coating and folding station, with a testing station, in which the carton packs are subjected to stress by pressure members generating pressure in the plane of the walls formed by the folding tabs or flaps. Carton packs with intact walls withstand the pressure.

Any faulty packs are detected in the region of a testing station and separated out by conveyor means. For this purpose, light barriers extend in a plane parallel to the walls formed from folding tabs, especially in a vertical plane. Folding tabs projecting somewhat sideways or adhesive strips, where an incorrectly affixed adhesive strip is concerned, are detected in this way.

Appropriately, the adhesive strip is affixed by means of a suitable applicator member after the testing station, but before the checking station in the conveying direction. In the region of the checking station, any incorrectly affixed or insufficiently adhering adhesive strips are also identified.

Further features of the invention relate to the design of members in the region of the testing station and in the region of the checking station and to measures for separating out and reintroducing faulty packs and corrected carton packs respectively.

An exemplary embodiment of the invention is explained in detail below by means of the drawings. In these:

DETAILED DESCRIPTION OF A PREFERRED EMBODIMENT

Figure 1:
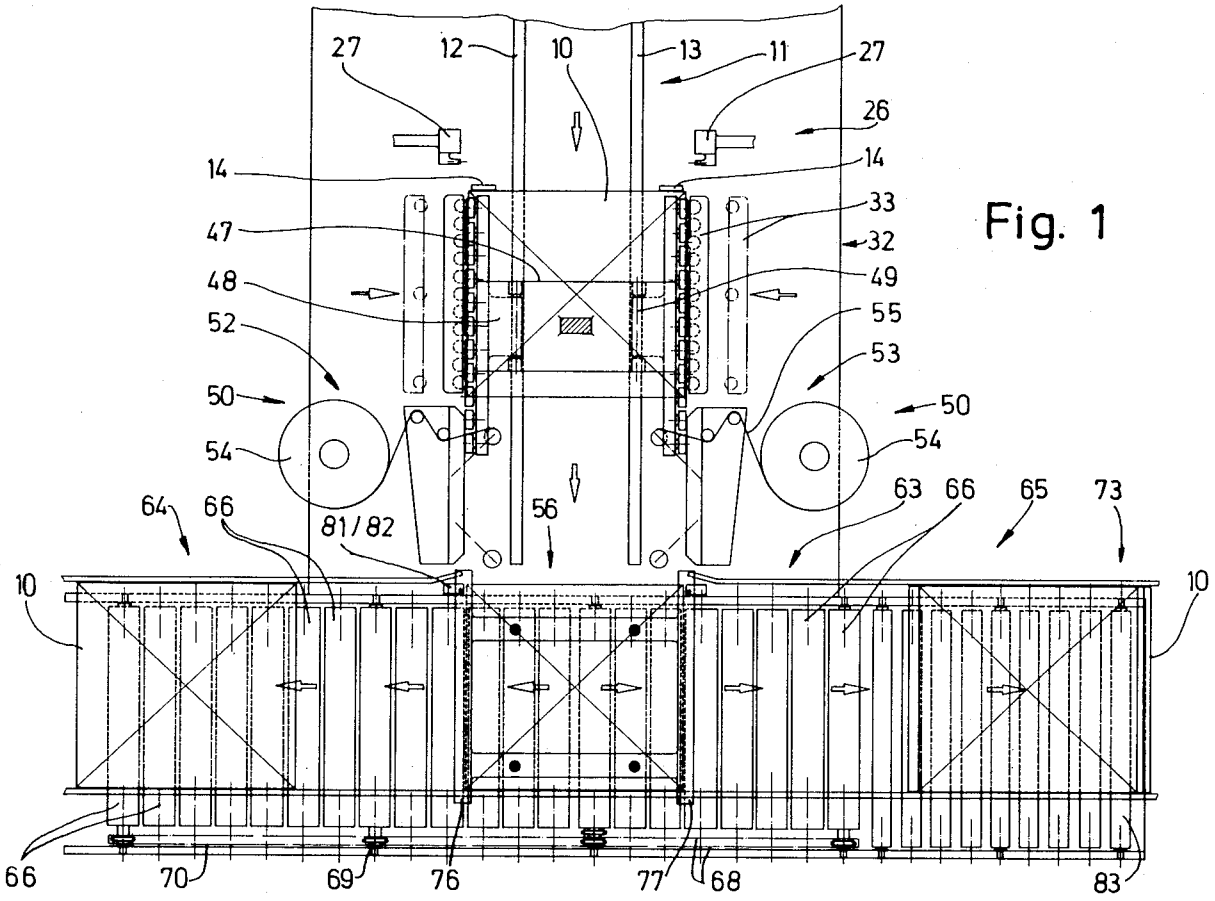
FIG. 1 shows a diagrammatic plan view of an apparatus for the testing of carton packs.
Figure 2:
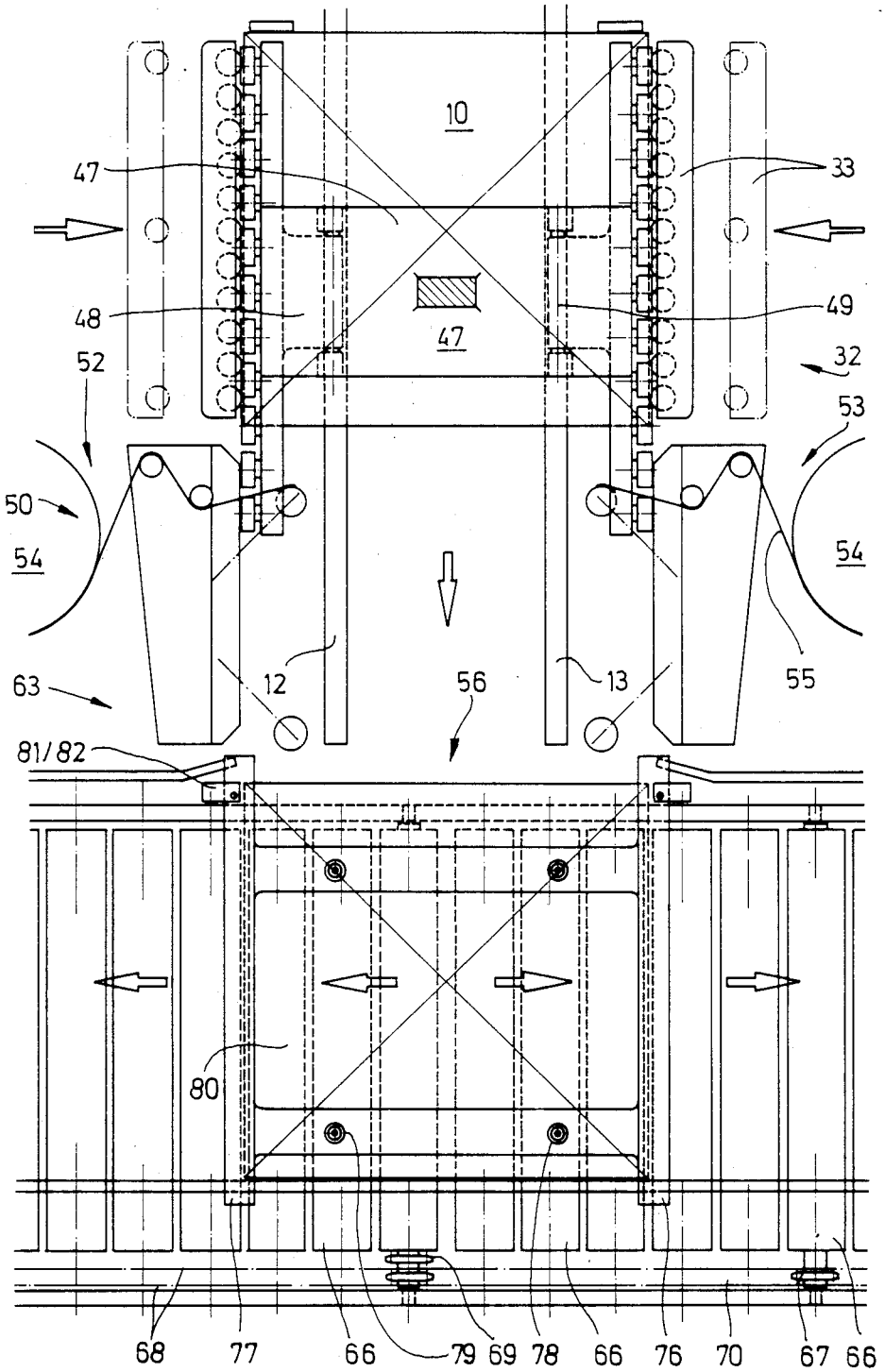
FIG. 2 shows a cutout from FIG. 1 on an enlarged scale.
Figure 3:
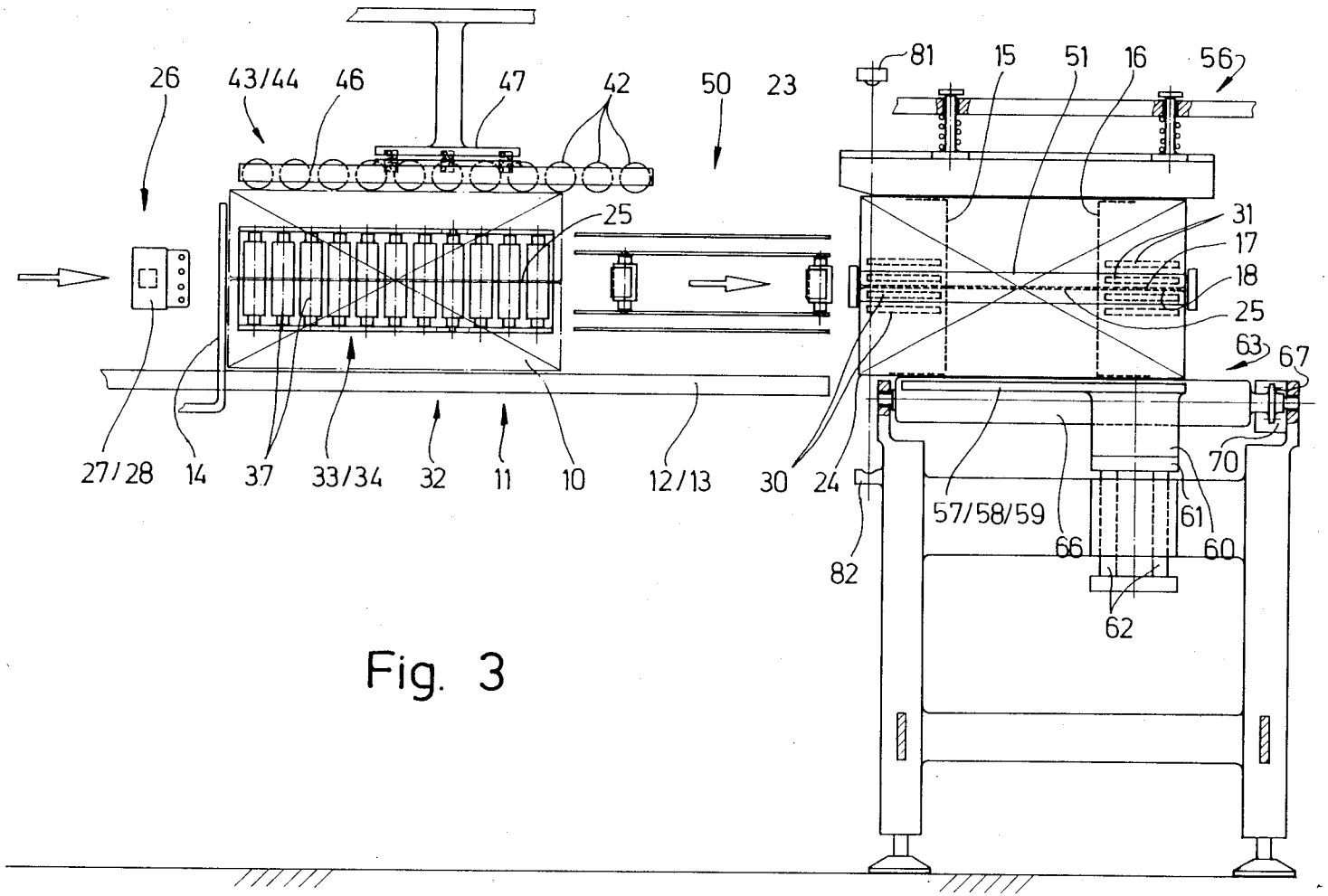
FIG. 3 shows a side view relating to FIG. 1.
Figure 4:
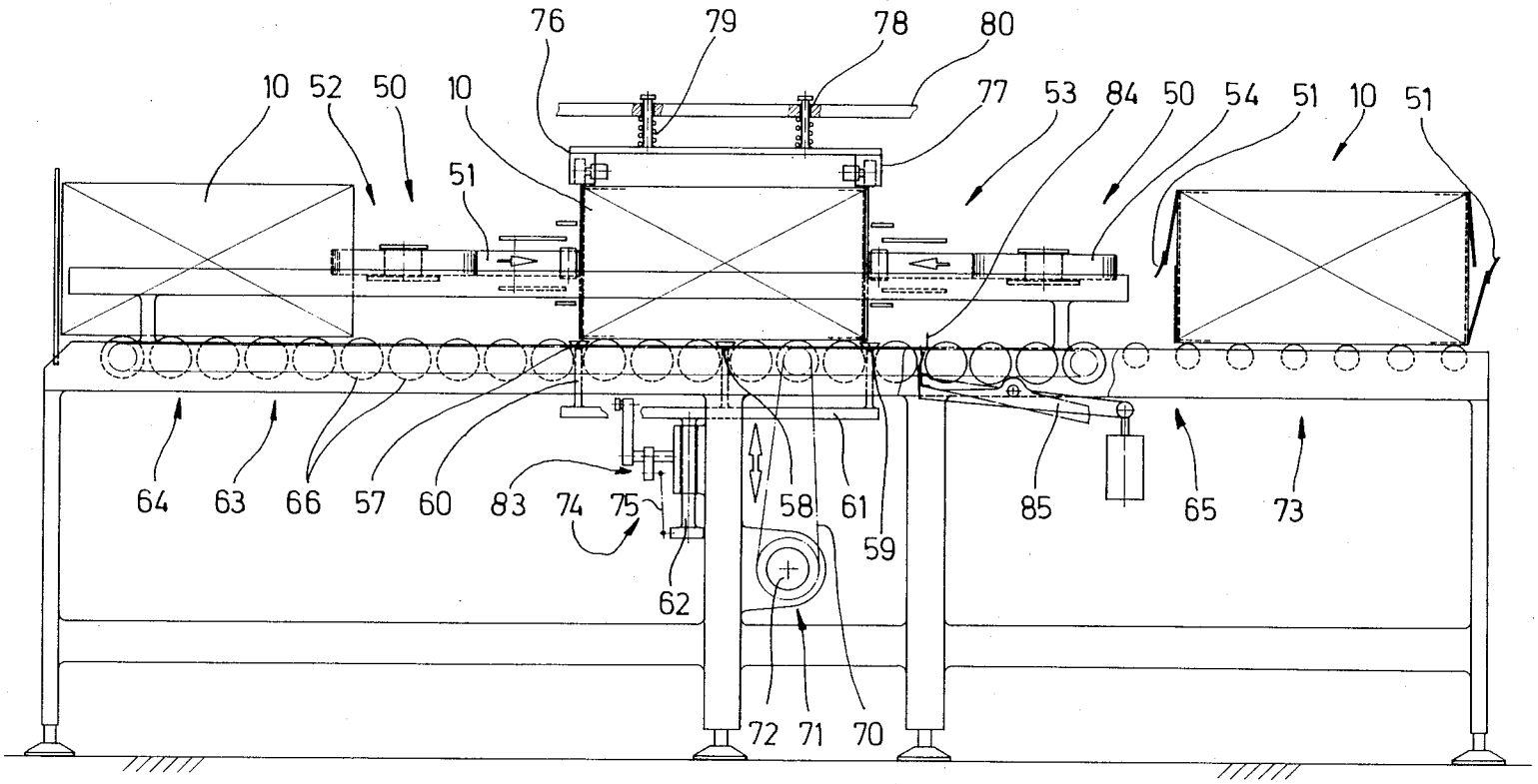
FIG. 4 shows a front view relating to FIG. 1.

The exemplary embodiment illustrated in the drawings relates to the production of carton packs 10, for example for receiving cigarette sticks. The carton packs 10 are transported (intermittently) on a feed-conveyor track 11. The feed-conveyor track 11 consists, here, of two supporting rods 12, 13 which are arranged at a distance from one another and on which the carton pack 10 rests and is moved further in a sliding manner. Transport takes place by means of drivers 14 of a (chain) conveyor which engage at the rear.

The carton pack 10 consists of a blank, for example made of corrugated cardboard, which surrounds the pack contents. The carton pack 10 is initially open on both sides, namely vertical side faces parallel to the conveying direction. The blank has folding tabs or flaps foldable on to one another, namely inner tabs 15, 16 and outer tabs or flaps 17, 18. The above-mentioned folding tabs 15 to 18 are folded over one another in order to form, for example, a bottom wall 19 and a cover wall 20. The inner tabs 15, 16 start from vertical edges 21, 22 located opposite one another, whilst the outer tabs 17, 18 merge via upper and lower horizontal edges 23, 24 into adjoining walls of the carton pack 10.

In the present example of a carton pack 10, the dimensions of the outer tabs or flaps 17, 18 are such that together they completely cover the bottom wall 19 and cover wall 20 respectively and butt against one another in the region of a parting line 25 which is arranged centrally.

Figure 5:
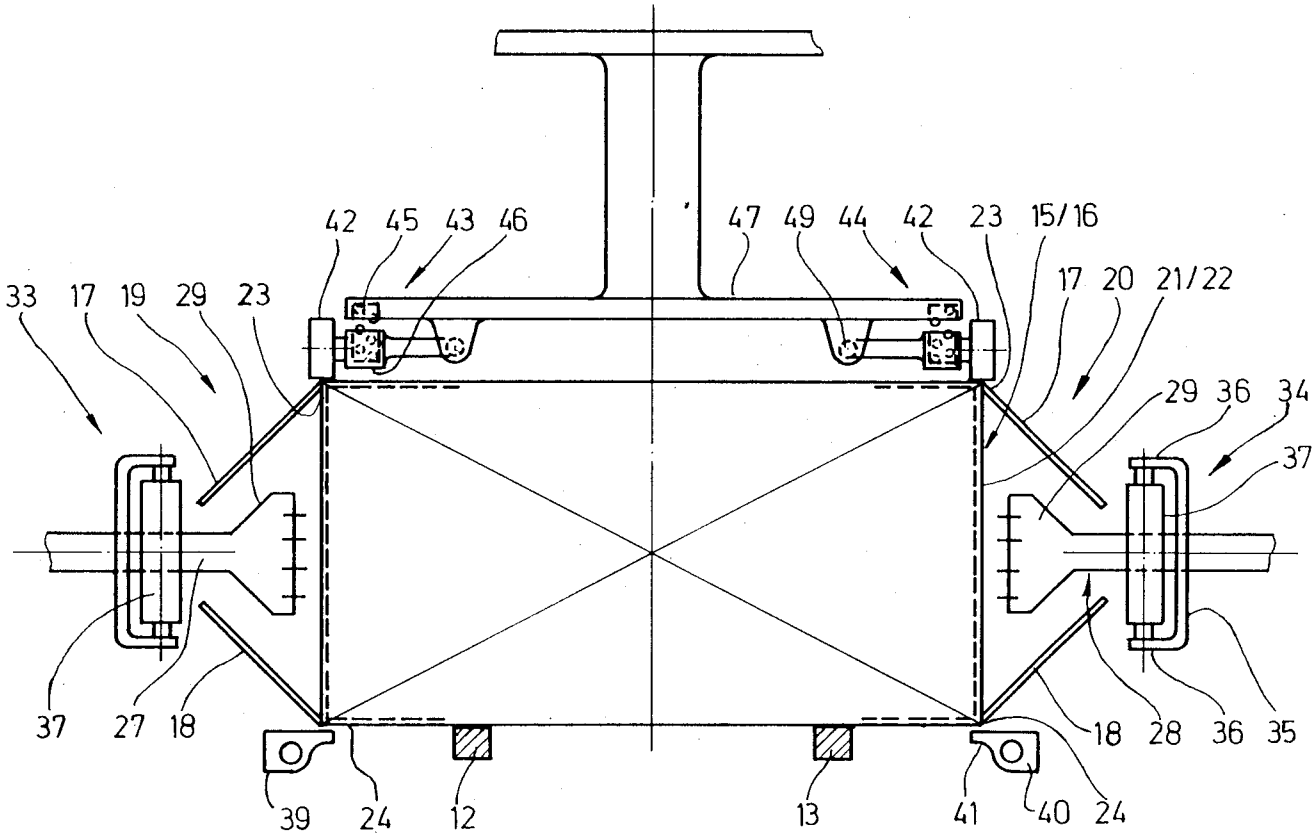
FIG. 5 shows a detail, in particular a transverse view of the apparatus in the region of a glue-coating and folding station.

The carton packs 10 are filled outside the units shown here and are partially folded in the region of the bottom wall 19 and cover wall 20, particularly with regard to the inner tabs 15, 16. These are already folded into the end position when the carton pack 10 enters the region of a glue-coating station 26. The outer tabs 17, 18 are prefolded here, so that they are in an inclined position (FIG. 5). During this relative movement of the outer tabs 17, 18, the carton pack 10 can be moved past gluing members 27, 28 arranged on both sides of the feed-conveyor track 11, in such a way that appropriately designed nozzle heads 29 extend adjacent to the inner face of the inclined outer tabs 17, 18 (FIG. 5). In this position, (hot-melt) glue strips 30, 31 can be sprayed on to the inner tabs 15, 16 in two successive spraying strokes.

The glue-coating station 26 is followed in the conveying direction by a folding station 32 in which two measures are carried out in the region of the folding tabs. On the one hand, the outer tabs 17, 18 are pressed against the inner tabs 15, 16, that is to say folded into the end position. On the other hand, after this folding step the outer tabs 17, 18 are corrected or aligned in terms of the relative position, in such a way that the outer tabs 17, 18 butt against one another in the region of the parting line 25.

Figure 6:
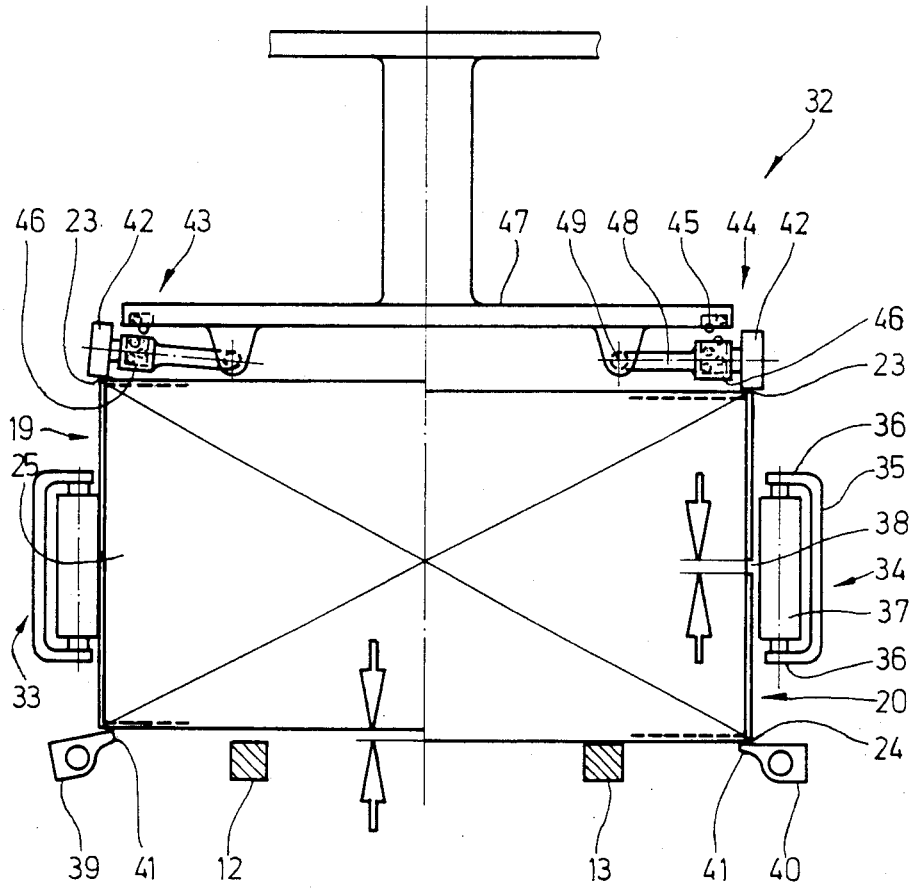
FIG. 6 shows a representation, similar to that of FIG. 4, in the region of a testing station for the carton packs.
Figure 7:
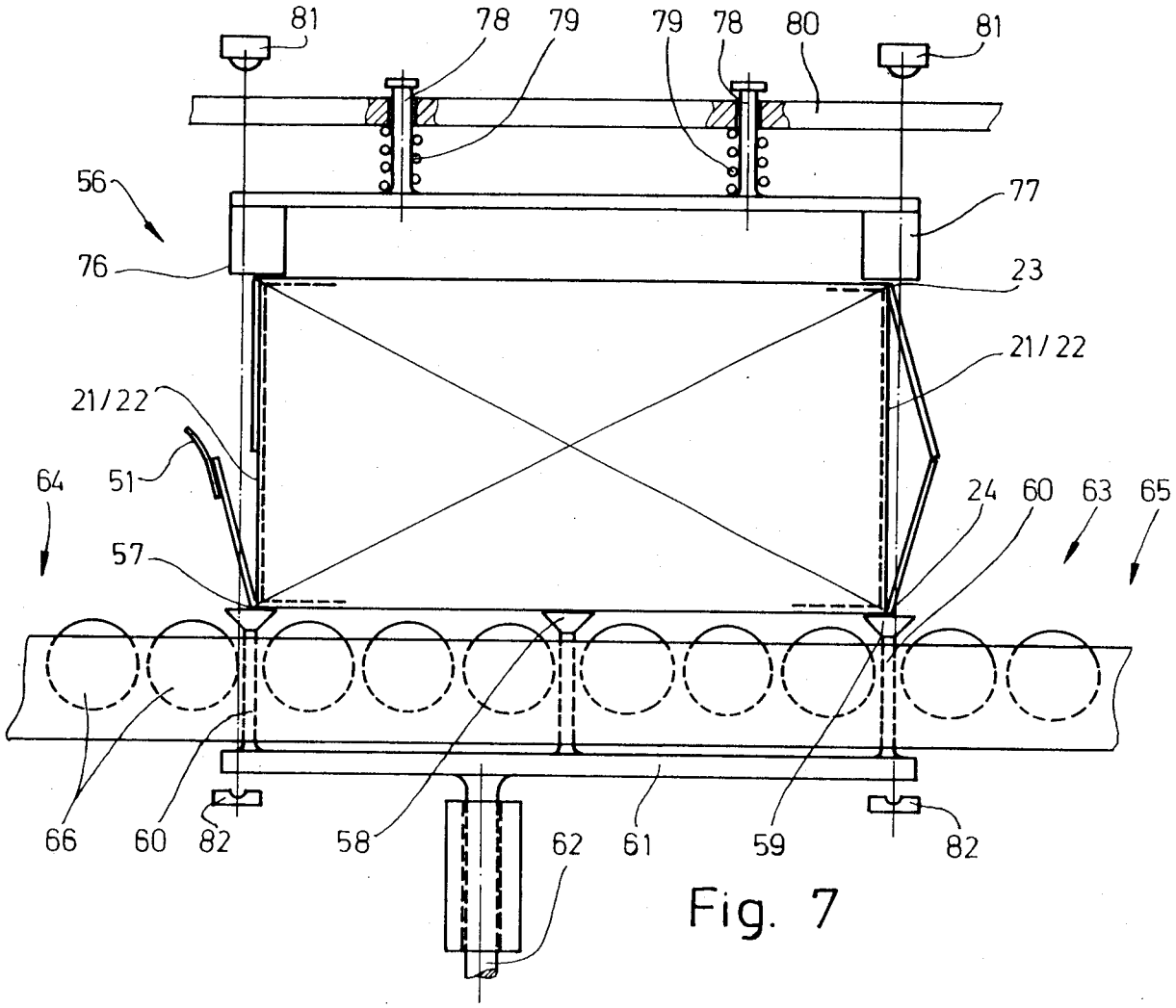
FIG. 7 shows a representation, similar to those of FIG. 4 and FIG. 5, in the region of a checking station for the tested carton packs.

For the first step, folding members movable in the transverse direction up against the carton pack 10 are arranged laterally next to the feed-conveyor track 11. In the present exemplary embodiment, these are roller folders 33, 34 located on both sides of the feed-conveyor track 11. Each roller folder 33, 34 consists of a U-shaped supporting frame 35 with horizontally directed flanges 36. Arranged within the supporting frame 35, particularly between the upper and lower flanges 36, is a relatively large number of freely rotatable pressure rollers 37 of vertical axis of rotation. The roller folders 33, 34 so designed are moved out of a retracted position (FIG. 5) into a folding position (FIG. 6, on the left), thereby coming to bear on the outer tabs 17, 18 pressed against the inner tabs 15, 16. The roller folders 33, 34 can remain in this folding or pressing position when the carton pack 10 is conveyed further out of the folding station 32 after the measures provided have been carried out.

In order to align the outer tabs 17, 18 in such a way that they rest with the free edges against one another in the region of the parting line 25, an oppositely directed pressure is exerted on the outer tabs 17, 18. As shown especially in FIG. 6, the carton packs 10 are lifted up against an upper abutment by lifting members. The outer tabs 17, 18 have thereby shifted until they come to bear on one another, at the same time overcoming a possible gap 38. During this correcting operation, the roller folders 33, 34 can be at a slight distance from the outer tabs 17, 18, as shown on the right in FIG. 6.

To exert the correcting pressure on the outer tabs 17, 18 the pressure members take effect in the region of the upper and lower horizontal edges 23 and 24. Lower lifting bars 39, 40 are pivoted about an axis parallel to the conveying direction, in such a way that noses 41 press under the (lower) horizontal edges 24 and lift the carton pack 10 off from the supporting rods 12, 13.

Elastically mounted, particularly upwardly movable pressure rollers 42 are arranged as abutments respectively in a steadying device 43, 44 on the opposite upper side. The steadying devices 43, 44 are arranged laterally above the path of movement of the carton packs 10, in such a way that a multiplicity of pressure rollers 42 rest against each upper horizontal edge 23.

The pressure rollers 42 can be moved upwards or move away counter to the load of a compression spring 45. For this purpose, the pressure rollers 42 of a particular steadying device 43 are arranged on an elongate beam 46 which is mounted pivotably on a crossmember 47 extending above the path of movement of the carton packs 10. For this purpose, the beam 46 is equipped with an extension 48 which is attached to the crossmember 47 by means of a joint 49. The compression springs 45 are likewise supported at the upper end on the crossmember 47 of appropriate dimensions.

The folding operation, described further above, by means of the roller folders 33, 34 and/or the alignment of the outer tabs 17, 18 until the free edges come to bear on one another can be carried out completely or partially during the transport of the carton packs 10. This is possible as a result of the design of the processing members with rollers or cylinders.

The ready-folded carton packs 10, by being transported further on the feed-conveyor track 11, enter the region of a tape station 50. Here, during the transport of the carton pack 10, an adhesive strip 51 is affixed to the side faces, that is to say to the bottom wall 19 and/or cover wall 20. The adhesive strip 51 is affixed in such a way that the parting line 25 between the two outer tabs 17, 18 is masked.

The adhesive strip 51 is applied by tape units 52, 53 of conventional design which are arranged on both sides of the feed-conveyor track. A tape 55 provided with adhesive is drawn off from a reel 54, transferred on to the carton pack 10, pressed against this and cut off in a suitable length.

The carton pack 10 completed by affixing the adhesive strip 51 passes on the feed-conveyor track 11 into a checking station 56. Here, the carton pack 10 is checked for a correct construction in the region of the bottom wall 19 and cover wall 20. .

For this purpose, pressure is exerted on the bottom wall 19 and cover wall 20 in the region of the upper and lower horizontal edges 23, 24. Inadequate adhesive bonds of the folding tabs result in an outward pivoting of these (FIG. 6, on the right), so that a faulty pack is detectable from outside.

To accomplish this exertion of pressure, the carton pack 10 is lifted, specifically by (three) pressure bars 57, 58, 59 which take hold of the carton pack 10 in the middle of the latter and in the region of the lower horizontal edges 23, 24. The pressure bars 57, 58, 59 are connected via vertical webs 60 to a transversely directed supporting girder 61 which is movable up and down by means of lifting rods 62.

During this phase (in the checking station 56), the carton pack 10 is located on a cross-conveyor 63, in the region of which the checking station 56 is formed after the feed-conveyor track 11. The cross-conveyor 63 is designed as a roller conveyor with two conveying portions 64 and 65. Correctly constructed carton packs 10 leave the checking station 56 via the conveying portion 64, that is to say to the left in FIG. 1. Faulty packs are separated out to the right via the conveying portion 65.

To execute these conveying movements, driving rollers 66 of the two conveying portions 64, 65 are movable in rotation in both directions by means of a common drive. For this purpose, the driving rollers 66 equipped with respective gear wheels 67 are connected to one another in transmission terms by means of a common chain drive 68. To this effect, each of the driving rollers 66 is equipped with a chain wheel 69 for a common drive chain 70 covering all the driving rollers 66. A common drive 71 having a reversible drive motor 72 is installed on the machine stand below the plane of the driving rollers 66. The drive motor 71 connected to one of the driving rollers 66 causes the driving rollers to rotate in one direction or the other, depending on whether an intact carton pack 10 is to be conveyed to the left on to the conveying portion 64 or a faulty carton pack 10 is to be conveyed to the right on to a conveying portion 65 and into a processing station 73.

The checking station 56 is formed after the feed-conveyor track 11 in the region of the cross-conveyor 63. For conducting the test, the carton packs 10 in the checking station 56 are lifted off from the driving rollers 66 of the cross-conveyor 63 by the pressure bars 57, 58, 59 and brought to bear against elastic pressure members arranged above the carton pack 10. These are likewise arranged in the region of the (upper) horizontal edges 23. The relatively narrow pressure bars 57 to 59 are arranged respectively between adjacent driving rollers 66 and can be lowered below the plane of the cross-conveyor 63. For this purpose, the lifting rod 62 is actuable by means of a lifting mechanism 74 consisting essentially of a plank assembly 75. The middle pressure bar 58 serves as an additional supporting member for the carton pack 10.

The counterpressure member mounted at a fixed location above the carton packs 10 consists, here, of two lateral pressure girders 76, 77. These are mounted on part of the machine stand, particularly on a support plate 80, via supporting bars with compression springs 79. During the upward movement of the carton pack 10, the pressure girders 76, 77 are lifted, at the same time increasing the pressing force. Pressure is thereby exerted on the walls (bottom wall 19 and cover wall 20) formed from the folding tabs and directed sideways and results in a springing open of folding tabs not properly bonded together.

Incorrectly constructed carton packs 10 are identified in the checking station 56 by optoelectrical sensors. In the present exemplary embodiment, photosensors, particularly a transmitter 81 and a receiver 82, are arranged above one another respectively on both sides of the path of movement of the carton packs 10 in the entry region of the checking station 56. The vertical light barrier formed between these is placed closely, particularly at only a slight distance, next to the sideways directed walls (bottom wall 19 and cover wall 20) of the carton pack 10. Possibly projecting parts of these walls, especially folding tabs and/or adhesive strips 51, are detected. As a result of this, the particular carton pack 10 is separated out into the processing station 73 by means of an appropriate drive of the driving rollers 66.

In the processing station 73, the defective carton pack 10 rests on freely rotatable, but non-driven supporting rollers 83. The defect on the carton pack 10 is rectified manually here. The corrected carton pack 10 is then returned to the feed stream, particularly during any gap in the conveyance of correct carton packs 10 and with an appropriate drive direction of the driving rollers 66.

The exact moment when the repaired carton pack 10 is introduced into the feed stream is determined by a stop 84 which retains the carton pack 10, resting on the driving rollers 66, in the lifted position until the way is free for the carton pack 10. The stop 84 is lowered by means of a pivoting lever 85, so that the carton pack 10 can then be conveyed away automatically.

What is claimed is:

1. A process for testing cartons for correct construction of bottom and cover walls formed by inner and outer folding flaps and fixed by means of adhesive bonding, in which immediately after said walls (19, 20) are completed by folding said folding flaps (15, 16; 17, 18), applying pressure to said walls, such that folding flaps of incorrectly formed walls move out of a wall plane, the cartons initially moving along a path of motion and then in a feed stream, said process comprising the steps of:

applying pressure to each wall to be tested, said pressure being produced by means of contact pressure members each engaging a wall adjoining the wall to be tested in the region of carton edges located at mutually opposite sides of a carton to be tested, and which contact pressure members move towards one another into the path of motion of the cartons (10) and thereafter in opposite directions out of said path of motion; and selecting defective cartons (10) out of the feed stream.

2. The process according to claim 1, wherein said pressure applying step further includes lifting each wall to be tested of the cartons (10) in a checking station (56) and pressing it against pressure girders (76, 77) disposed above the carton (10) by means of pressure bars (57, 58, 59) disposed below the cartons (10) and moved by actuating means, said pressure girders and pressure bars forming said contact pressure members.

3. The process according to claim 2, further comprising detecting possible faults in a region of the tested walls by a vertical light barrier (81, 82) in an entry region of said checking station (56).

4. The process according to claim 1, further comprising: after application of an adhesive and folding of said folding flaps (15 to 18) into the plane of said walls, correcting the relative position of said folding flaps (15 to 18), which are directed sideways in relation to a conveying direction of said cartons (10), by correcting the abutting position of horizontally oriented edges of the outer folding flaps (17, 18) in the region of a parting line (25); and carrying out said correcting by applying pressure onto said outer flaps (17, 18) transversely relative to said parting line (25).

5. The process according the claim 4, further comprising, in the region of a folding station (32) downstream of a glue-coating station (26), pressing said cartons (10) by lifting them up against upper pressure members (43, 44) arranged in the plane of the sideways directed walls (18, 19).

6. The process according to claim 1 or 2, comprising manually processing the defective cartons (10) selected out of the feed stream in the region of a processing station (73) and reintroducing them into the feed stream after a fault has been rectified.

7. An apparatus for testing filled carton packs for correct construction of bottom and cover walls (19, 20) formed by folding flaps and fixed by means of adhesive bonding, wherein the filled carton packs (10) pass through a glue-coating station (26) and, thereafter, through a folding station (32), said apparatus comprising: a checking station (56) located downstream of said glue-coating and said folding stations along a path of motion of the carton packs (10), for testing correct construction of the walls (19, 20) to be tested, said checking station (56) including contact pressure members applying pressure to the folding flaps of the walls (19, 20) to be tested; wherein said contact pressure members comprise pressure bars (57, 58, 59) and pressure girders (76, 77) which move to engage walls adjoining the bottom and cover walls (19, 20) to be tested in the region of carton edges (23, 24) at mutually opposite sides of a carton (10) to be tested and which move towards one another into the path of motion of the carton (10) to be tested and in opposite directions out of said path of motion by means of an actuating means for applying a pressure in the plane of the walls (19, 20) to be tested.

8. The apparatus according to claim 7, wherein in said checking station (56), next to sideways oriented bottom and cover walls (19, 20) to be checked, and parallel to the wall plane, vertically oriented light barriers (81, 82) are arranged.

9. The apparatus according to claim 7, wherein said pressure bars (57, 58, 59) are disposed below the carton (10) to be tested and move upwardly and downwardly via said actuating means and take effect counter to said pressure girders (76, 77) which are mounted at a fixed location above the carton (10) to be tested and which are spring biased.

10. The apparatus according to claim 9, further comprising, upstream of said checking station (56), a folding station (32) in which the bonded outer flaps (17, 18) are oriented until mutually confronting free edges thereof come to abut in the region of a parting line (25).

11. The apparatus according to claim 10, wherein said parting line (25) between said outer flaps (17, 18) is horizontally oriented, and further comprising means for stressing said outer flaps from above and below so that said outer flaps (17, 18) are shifted until said free edges come to abut.

12. The apparatus according to claim 11, further comprising lifting bars (39, 40) for lifting said cartons (10) in said folding station (32), said lifting bars engaging a carton bottom side, so that a carton (10) is pressed against elastic counterpressure rollers (42) taking effect above said carton (10) in the region of the upper horizontal carton edges (23).

13. The apparatus according to claim 11, wherein said stressing means comprises pressing rollers (37) for stressing said outer flaps (17, 18) during transport of said cartons (10), said pressing rollers (37) coming into contact with said outer flaps (17, 18) in the region of said parting line (25).

14. The apparatus according to claim 9, wherein the actuating means for the pressure bars (57, 58, 59) is a lifting mechanism (74) which moves said pressure bars (57, 58, 59) upwardly and downwardly via vertical webs (60), a transversely directed supporting girder (61) connected therewith and lifting rods (62) communicating with said supporting girder (61).

15. The apparatus according to claim 7 or 9, wherein said checking station (56) is part of a conveyor (63) for said cartons (10), said conveyor being alternatively driven in one direction or the other, such that cartons (10) found to have no defects are transported by said conveyor in one direction, and defective cartons (10) are transported in the other direction into a processing station (73).

16. The apparatus according to claim 15, wherein said conveyor (63) for the cartons (10) is a roller conveyor, said pressure bars (57, 58, 59) being disposed between adjacent driving rollers (66) of the conveyor (63) and being lowered out of the path of motion of the carton (10) after applying pressure.

* * * * *